US006640078B2

(12) United States Patent
Ishii et al.

(10) Patent No.: US 6,640,078 B2
(45) Date of Patent: Oct. 28, 2003

(54) ELECTROPHOTOGRAPHIC APPARATUS HAVING A PAPER HOLDING MEMBER

(75) Inventors: Kenji Ishii, Ibaraki (JP); Masayuki Ainoya, Ibaraki (JP); Junji Shirakawa, Ibaraki (JP); Minoru Seino, Ibaraki (JP); Hideki Ando, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/756,200

(22) Filed: Jan. 9, 2001

(65) Prior Publication Data

US 2001/0010769 A1 Aug. 2, 2001

(30) Foreign Application Priority Data

Jan. 4, 2000 (JP) ..... 2000-005344

(51) Int. Cl.[7] ..... G03G 15/16; G03G 15/14

(52) U.S. Cl. ..... 399/316

(58) Field of Search ..... 399/316, 317

(56) References Cited

U.S. PATENT DOCUMENTS

| | | | | | |
|---|---|---|---|---|---|
| 4,392,738 | A | * | 7/1983 | Fujino et al. | 399/317 |
| 4,847,652 | A | * | 7/1989 | Masuda et al. | 399/148 |
| 4,882,606 | A | * | 11/1989 | Deguchi | 399/316 |
| 5,319,423 | A | * | 6/1994 | Takeda et al. | 399/298 |
| 5,412,460 | A | * | 5/1995 | Okazaki et al. | 399/316 |

* cited by examiner

*Primary Examiner*—Quana M. Grainger
(74) *Attorney, Agent, or Firm*—Sughrue Mion, PLLC

(57) ABSTRACT

A transfer guide is provided which includes a guide member for guiding paper to a transfer point and a paper holding member using an electrically conductive member attached to the guide member by means of a spring member and disposed in the vicinity of a surface of a photosensitive drum, such that the gap becomes narrow for thin paper and the gap widens for thick paper in correspondence with the ream weight of the paper.

9 Claims, 2 Drawing Sheets

ELECTROPHOTOGRAPHIC APPARATUS HAVING A PAPER HOLDING MEMBER

BACKGROUND OF THE INVENTION

1. Field of the Invention

The present invention relates to an electrophotographic cut-paper printer.

2. Description of the Related Art

A conventional transfer guide guides paper to a transfer point by means of a fixed member using a plastic member. As for a gap between the transfer guide and a photosensitive drum, which is an OPC drum, in a case where various types of paper ream weight are supported, a gap of 1 mm or more is required. Accordingly, there have been cases where, in order to improve the transferability of paper having small ream weight, a nip guide mechanism is jointly used to press the paper onto the photosensitive drum from the reverse side of the paper in synchronism with a paper transporting timing.

With a conventional guide member 1 shown in FIG. 2, if consideration is given to booking by a printer, for which there has been an increasingly strong demand, it is necessary to support various types of ream weight and paper sizes. Accordingly, in order to improve the transferability of paper having small ream weight (thin paper), it is necessary to make a gap B at the guide member 1 small and increase the amount of winding (the distance between a distal end of the guide member and a point of intersection (transfer point 5) between the surface of a photosensitive drum 10 and a line connecting the center (not shown) of the photosensitive drum and a transfer wire 7 (of a transfer unit 6) around the photosensitive drum 10. In the case of paper having large ream weight (thick paper), since the gap B at the transfer guide is narrow, frictional resistance at the distal end of the guide member 1 with respect to paper 8 become large, with the result that there has been a drawback in that a transport failure (paper jamming or the like) occurs. In addition, although the surface of the guide member is in some cases provided with Teflon (registered trademark by DuPont) coating to prevent faulty transport, since the Teflon (registered trademark by DuPont) coating has an insulating property, the surface becomes electrically charged during the passage of the paper and attracts the toner, with the result that there has been a drawback in that the smudging of the back side of the paper occurs. Although in a case where support is provided up to thick paper, it is necessary to enlarge the gap between the guide member 1 and the surface of the photosensitive drum 10 and reduce the amount of winding, whereas, in the case of thin paper, since the gap B is made large and the amount of winding is reduced, the contact quality declines, so that there is a drawback in that the transfer characteristic deteriorates.

To prevent the above-described problems, there are cases where a nip guide 9 and an actuating mechanism 12 for pressing the paper against the photosensitive drum 10 from the reverse side of the paper in synchronism with the paper transporting timing are jointly used, as shown in FIG. 3. In this case, however, if paper having a width narrower than the nip guide 9 is printed, since the nip guide 9 and the photosensitive drum 10 are brought into contact with each other, there has been a drawback in that the nip guide 9 is smudged by a very small amount of toner remaining on the surface of the photosensitive drum 10, and back smudge of first several sheets of paper occurs if the paperwidth is subsequently changed and paper having a large width is printed. In addition, since a complex mechanism is added, there are problems in that the cost of a transfer section increases substantially, and that reliability declines.

SUMMARY OF THE INVENTION

An object of the invention is to overcome the above-described problems, and an electrophotographic cut-paper printer in accordance with the invention can be realized by using a transfer guide having a paper holding member using an electrically conductive member attached to a guide member by means of a spring member and disposed in a vicinity of a surface of a photosensitive drum, such that the gap becomes narrow for thin paper and the gap widens for thick paper in correspondence with the ream weight of the paper.

It should be noted that, in Japan, by using 70 kg paper as a boundary, paper having smaller ream weight is set as thin paper and paper having larger ream weight is set as thick paper.

DETAILED DESCRIPTION OF THE PREFERRED EMBODIMENTS

Hereafter, a description will be given of preferred embodiments of the invention with reference to the drawings.

Figure 4:
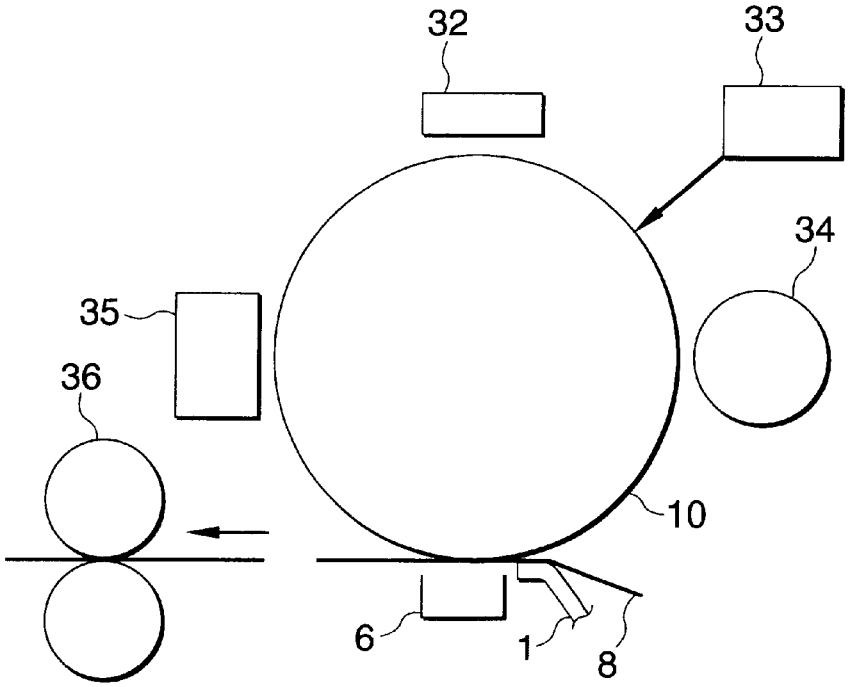
FIG. 4 is a schematic diagram of a photosensitive drum and its vicinities in the electrophotographic apparatus.

FIG. 4 is a schematic diagram in which a photosensitive drum of an electrophotographic apparatus and its vicinities are schematically illustrated.

A charger 32, an optical unit 33, a development unit 34, a transfer unit 6, and a cleaner 35 are arranged around a photosensitive drum 10. Paper 8 (cut paper) is transported from an unillustrated hopper, and a latent toner image formed by the developing unit 34 is transferred onto the paper 8 by the transfer unit 6, and is fixed by a fixing unit 36. Before transfer, the paper 8 is guided to the transfer unit 6 by a guide member 1.

Next, referring to FIG. 1, a description will be given of an embodiment of the invention.

Figure 1:
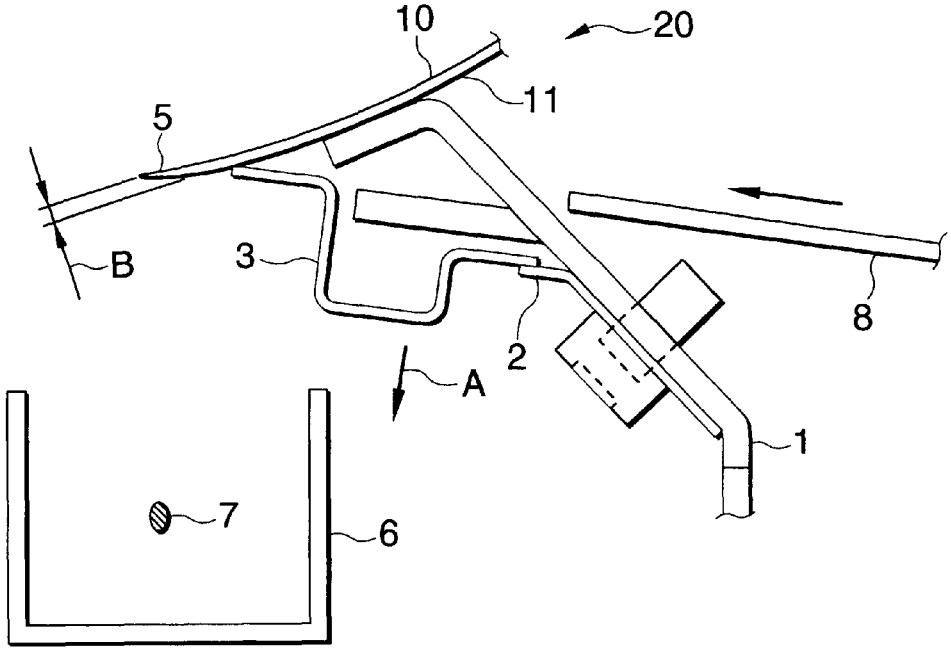
FIG. 1 is a schematic diagram of a transfer unit and its vicinities in an electronic cut-paper printer in accordance with the invention.
Figure 2:
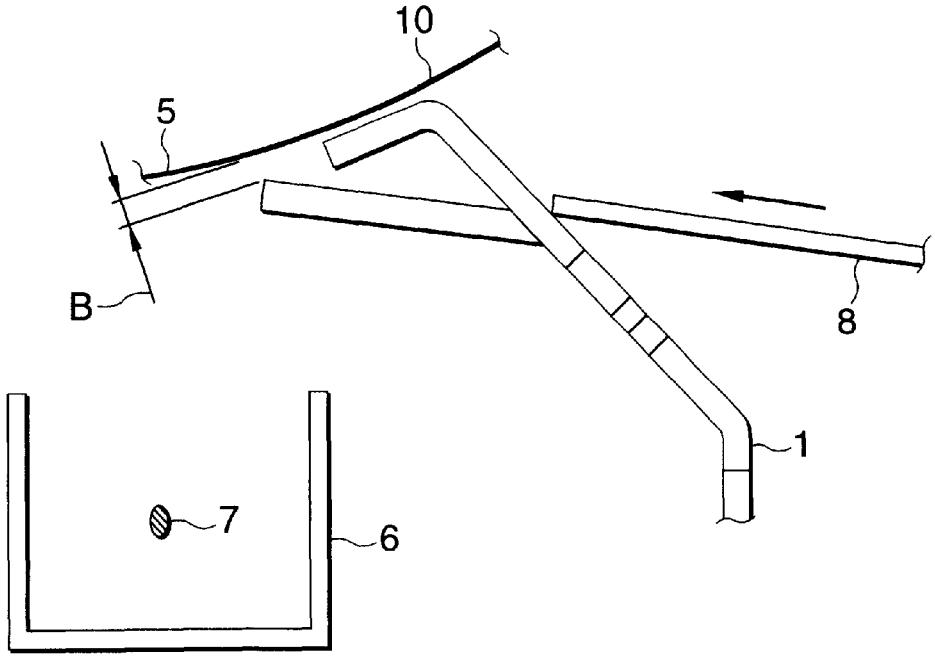
FIG. 2 is a schematic diagram of a transfer unit and its vicinities in a conventional electrophotographic cut-paper printer.
Figure 3:
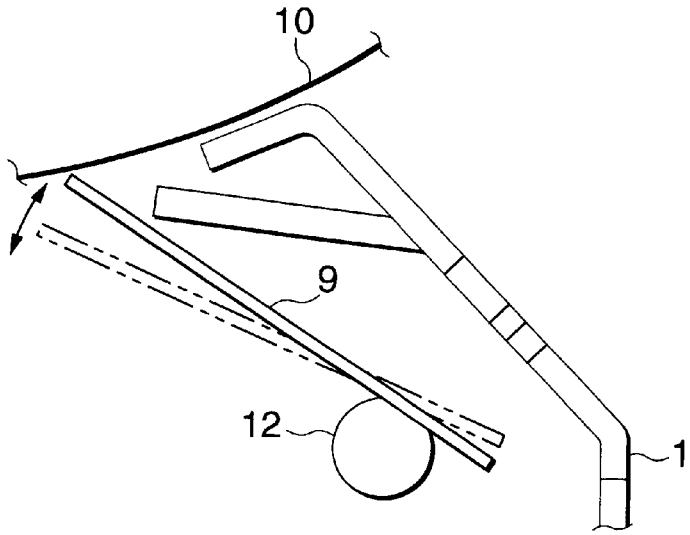
FIG. 3 is a schematic diagram of a nip guide mechanism.

In FIG. 1, the paper 8 transported from a resist unit (not shown) is brought into contact with the photosensitive drum 10 by the guide member 1 and a paper holding member 3 attached means of a spring member 2, and is guided to a transfer point 5. A latent toner image is transferred onto the paper 8 by the transfer unit 6 at the transfer point 5, and is transported to the fixing unit 36. In addition, the paper holding member 3 is brought into contact with a pair of gap-forming protrusions 11 located at a photosensitive drum unit 20 so as to secure a gap B with respect to the photosensitive drum 10.

In the case of thin paper, the rigidity of the spring member 2 is made stronger than the rigidity of the paper 8, and the amount of winding around the photosensitive drum is secured to some degree. To prevent faulty transfer during the two-side printing of the thin paper and eliminate faulty transport of the thick paper, the amount of winding around the photosensitive drum 10 is set to at least not less than 5% of the diameter of the photosensitive drum 10, or 5 mm to 9 mm or thereabouts to cite a typical example. If the amount of winding at this time is less than 5 mm, faulty transfer is likely to occur during the two-side printing of the thin paper, and if it is more than 9 mm, faulty transport (offset in transfer) of the thick paper can occur. In the case of the thick paper, since the rigidity of the spring member 2 is made weaker than the rigidity of the paper, the spring member is deflected in the direction of A, and the gap between the paper holding member 3 and the photosensitive drum 10 consequently widens, so that the amount of winding around the photosensitive drum 10 is decreased, thereby improving the transportability of the thick paper. Further, if Teflon (registered trademark by DuPont)-mixed nickel plating (e.g., Kaniflon plating made by JAPAN KANIGEN CO., LTD.) which is capable of securing electrical conductivity is provided on the surface of the paper holding member 3, the frictional resistance between the paper and the paper holding member 3 decreases, so that the transportability of the paper improves. At this time, the longitudinal rigidity of the paper holding member 3 is made sufficiently stronger than the flexural rigidity of the spring member 2, and the spring member 2 is disposed in the vicinities of the protrusions for securing the gap B, thereby allowing the paper holding member 3 to be deflected while holding a gap parallel to the photosensitive drum 10. Specifically, the paper holding member 3 is formed in a U-shape to secure the longitudinal rigidity of the photosensitive material, while the spring member 2 is disposed only in the vicinities of the protrusions for securing the gap B.

As regards the back-side smudging of the paper, since the paper holding member 3 is not in contact with the photosensitive drum, the adhesion of toner is nil, and the back-side smudging of the paper due to the change in the dimension of the paper width can be prevented. Accordingly, in order to ensure the transferability of the thin paper and prevent the back-side smudging due to the adhesion of toner to the paper holding member 3, the gap between the photosensitive drum 10 and the paper holding member 3 needs to be set to at least not less than the maximum paper thickness of printable thick paper, and a dimension which is approximately twice as large as that thickness needs to be set as a limit. Specifically, the gap needs to be set to 0.2 mm to 0.5 mm or thereabouts. If the gap is less than 0.2 mm, the paper holding member 3 is likely to be smudged due to the scattering of the toner from the photosensitive drum 10, whereas if the gap is greater than 0.5 mm, a decline in the transferability during the two-side printing of the thin paper occurs. To secure that gap, the pair of protrusions 11 for securing the gap are respectively provided at positions located at both ends of the photosensitive drum of the photosensitive drum unit 20. In FIG. 1, the protrusions are formed annularly with the same height. In addition, a similar advantage can be obtained if protrusions for securing the gap are provided on the paper holding member 3 side at portions of the drum unit or portions falling outside a printing area.

It should be noted that, in the United States, by using 24 lb. paper as a boundary, paper having smaller ream weight is set as thin paper and paper having larger ream weight is set as thick paper.

As described above, since there is provided the transfer guide including the guide member for guiding the paper to the transfer point and the paper holding member attached to the guide member by means of the spring member and disposed in the vicinity of the surface of the photosensitive drum, such that the gap becomes narrow for thin paper and the gap widens for thick paper in correspondence with the ream weight of the paper, irrespective of the relative magnitude of the ream weight of the paper and the relative magnitude of the paper width it is possible to ensure transferability, ensure transportability of the paper, and prevent the smudging of the back side of the paper. In addition, the apparatus can be manufactured at low cost, and the reliability can be improved.

What is claimed is:

1. An electrophotographic apparatus having a transfer unit for transferring an exposed and developed toner image on a photosensitive drum and adapted to print cut paper, said apparatus comprising:

a transfer guide including a guide member for guiding the paper to a transfer point of said transfer unit and a paper holding member using an electrically conductive member attached to said guide member by a spring member and disposed in a vicinity of a surface of said photosensitive drum;

wherein the rigidity of said spring member is made stronger than the rigidity of thin paper, and is weaker than the rigidity of thick paper.

2. The electrophotographic apparatus according to claim 1, wherein a surface of said paper holding member is provided with Teflon-mixed nickel plating.

3. The electrophotographic apparatus according to claim 1, wherein a gap between said paper holding member and the surface of said photosensitive drum is set to at least not less than the thickness of printable paper.

4. The electrophotographic apparatus according to claim 1, further comprising:

a photosensitive drum unit including said photosensitive drum;

wherein an abutment portion is disposed on said photosensitive drum unit to maintain a gap between said paper holding member and said photosensitive drum.

5. The electrophotographic apparatus according to claim 1, wherein an abutment portion is disposed on said paper holding member to maintain a gap between said paper holding member and said photosensitive drum.

6. The electrophotographic apparatus according to claim 1, wherein said transfer unit having a transfer wire is provided; and wherein a distance from a distal end of said paper holding member to the transfer point which is a point of intersection between the surface of said photosensitive drum and a line connecting a center of said photosensitive drum and said transfer wire is set to not less than 5% of the diameter of said photosensitive drum.

7. An electrophotographic apparatus having a transfer unit for transferring an exposed and developed toner image on a photosensitive drum and adapted to print cut paper, said apparatus comprising:

a transfer guide including a guide member for guiding the paper to a transfer point of said transfer unit and a paper holding member attached to said guide member by a spring member and disposed in a vicinity of a surface of said photosensitive drum;

wherein the rigidity of said spring member is made stronger than the rigidity of thin paper, and weaker than the rigidity of thick paper.

8. The electrophotographic apparatus according to claim 7, further comprising:

a photosensitive drum unit including said photosensitive drum, wherein an abutment portion is disposed on said photosensitive drum and contacts with said paper holding member to maintain a gap between said paper holding member and said photosensitive drum.

9. The electrophotographic apparatus according to claim 7, wherein an abutment portion is disposed on said paper holding member and contacts said photosensitive drum to maintain a gap between said paper holding member and said photosensitive drum.

* * * * *